US010174563B2

(12) United States Patent
Thomas

(10) Patent No.: US 10,174,563 B2
(45) Date of Patent: Jan. 8, 2019

(54) REAL-TIME VARIABLE DEPTH OF CUT CONTROL FOR A DOWNHOLE DRILLING TOOL

(71) Applicant: Halliburton Energy Services, Inc., Houston, TX (US)

(72) Inventor: Jeffrey Gerard Thomas, Magnolia, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/504,041

(22) PCT Filed: Sep. 18, 2014

(86) PCT No.: PCT/US2014/056325

§ 371 (c)(1),
(2) Date: Feb. 15, 2017

(87) PCT Pub. No.: WO2016/043755

PCT Pub. Date: Mar. 24, 2016

(65) Prior Publication Data

US 2017/0275951 A1 Sep. 28, 2017

(51) Int. Cl.

| | |
|---|---|
| ***E21B 10/62*** | (2006.01) |
| ***E21B 10/42*** | (2006.01) |
| ***E21B 10/43*** | (2006.01) |

(52) U.S. Cl.

CPC ..... *E21B 10/62* (2013.01); *E21B 10/42* (2013.01); *E21B 10/43* (2013.01)

(58) Field of Classification Search

CPC ..... E21B 10/62; E21B 10/42; E21B 10/43
See application file for complete search history.

(56) References Cited

U.S. PATENT DOCUMENTS

| | | | | |
|---|---|---|---|---|
| 5,064,007 | A | 11/1991 | Kaalstad | |
| 5,558,170 | A | 9/1996 | Thigpen et al. | |
| 6,460,631 | B2 | 10/2002 | Dykstra et al. | |
| 2006/0278436 | A1 | 12/2006 | Dykstra et al. | |
| 2009/0044979 | A1 | 2/2009 | Johnson et al. | |
| 2009/0107722 | A1 * | 4/2009 | Chen | E21B 7/064 175/25 |

(Continued)

FOREIGN PATENT DOCUMENTS

| | | |
|---|---|---|
| CN | 101778992 | 7/2010 |
| CN | 202673149 | 1/2013 |

(Continued)

OTHER PUBLICATIONS

International Search Report and Written Opinion, Application No. PCT/US2014/056325; 20 pgs., dated May 29, 2015.

(Continued)

*Primary Examiner* — David J Bagnell
*Assistant Examiner* — Kristyn A Hall
(74) *Attorney, Agent, or Firm* — Baker Botts L.L.P.

(57) ABSTRACT

A drill bit is disclosed. The drill bit includes a bit body and a plurality of blades on the bit body. A cutting element is located on one of the plurality of blades and is communicatively coupled to a depth of cut controller (DOCC) located on the one of the plurality of blades. The DOCC is coupled to the cutting element such that the DOCC moves in response to an external force on the cutting element.

27 Claims, 5 Drawing Sheets

(56) References Cited

U.S. PATENT DOCUMENTS

| | | | | |
|---|---|---|---|---|
| 2010/0089662 | A1 | 4/2010 | Mumma | |
| 2010/0314173 | A1 | 12/2010 | Hbaieb et al. | |
| 2013/0238245 | A1 | 9/2013 | Chen et al. | |
| 2014/0332271 | A1* | 11/2014 | Do | E21B 10/42 175/57 |

FOREIGN PATENT DOCUMENTS

| | | |
|---|---|---|
| EP | 0874128 | 12/2004 |
| WO | 2009/022114 | 2/2009 |
| WO | 2012/064953 | 5/2012 |
| WO | 2013-176664 | 11/2013 |
| WO | 2014-012038 | 1/2014 |

OTHER PUBLICATIONS

Office Action received for Chinese Patent Application No. 201480080963.5, dated May 30, 2018; 14 pages.

* cited by examiner

REAL-TIME VARIABLE DEPTH OF CUT CONTROL FOR A DOWNHOLE DRILLING TOOL

RELATED APPLICATIONS

This application is a U.S. National Stage Application of International Application No. PCT/US2014/056325 filed Sep. 18, 2014, which designates the United States, and which is incorporated herein by reference in its entirety.

TECHNICAL FIELD

The present disclosure relates generally to downhole drilling tools and, more particularly, to real-time variable depth of cut control for a downhole drilling tool.

BACKGROUND

Various types of tools are used to form wellbores in subterranean formations for recovering hydrocarbons such as oil and gas. Examples of such tools include rotary drill bits, hole openers, reamers, and coring bits. Two major categories of rotary drill bits are fixed cutter drill bits and roller cone drill bits. A fixed cutter drill bit (alternately referred to in the art as a "drag bit") has a plurality of cutting elements, such as polycrystalline diamond compact (PDC) cutting elements, at fixed positions on the exterior of a bit body. Fixed cutter bits typically have composite bit bodies comprising a matrix material, and may be referred to in that context as "matrix" drill bits. Roller cone drill bits, by contrast, have at least one, and typically a plurality, of roller cones rotatably mounted to a bit body. A cutting structure, which may include discrete cutting elements and/or an abrasive structure, is affixed to the roller cones, which rotate about their respective roller cone axis while drilling.

Bits are typically selected according to the properties of the formation to be drilled. Fixed-cutter bits work well for certain formations, while roller cone bits work better for others. A large variety of different cutting structures and configurations are available among these two major categories of drill bits, to more particularly specify the drill bit to be used to drill a particular formation.

In a typical drilling application, a drill bit (either fixed-cutter or rotary cone) is rotated to form a wellbore. The drill bit is coupled, either directly or indirectly to a "drill string," which includes a series of elongated tubular segments connected end-to-end. An assembly of components, referred to as a "bottom-hole assembly" (BHA) may be connected to the downhole end of the drill string. In the case of a fixed-cutter bit, the diameter of the wellbore formed by the drill bit may be defined by the cutting elements disposed at the largest outer diameter of the drill bit. A drilling tool may include one or more depth of cut controllers (DOCCs). A DOCC is a physical structure configured to (e.g., according to their shape and relative positioning on the drilling tool) control the amount that the cutting elements of the drilling tool cut into a geological formation. A DOCC may provide sufficient surface area to engage with the subterranean formation without exceeding the compressive strength of the formation. Conventional DOCCs are fixed on the drilling tool by welding, brazing, or any other suitable attachment method, and are configured to engage with the formation to maintain a pre-determined rate of penetration based on the compressive strength of a given formation.

BRIEF DESCRIPTION OF THE DRAWINGS

For a more complete understanding of the present invention and its features and advantages, reference is now made to the following description, taken in conjunction with the accompanying drawings, in which.

DETAILED DESCRIPTION

A drill bit may include a real-time variable depth of cut controller (DOCC) which may be designed to engage with the subterranean formation and control the depth of cut of the cutting elements on the drill bit. The real-time variable DOCC may provide depth of cut control under a variety of conditions in the wellbore. A drill bit may drill through geological layers of varying compressive strengths during a drilling operation which may result in changing forces acting on the cutting elements based on the compressive strength. The real-time variable DOCC may extend from, and retract into, the surface of a blade of the drill bit in response to changes in the force acting on the cutting element. The force acting on the cutting element may be communicated to the DOCC via a mechanical, fluidic, or electrical connection. The extension and retraction of the DOCC may change the surface area of the DOCC that engages with the subterranean formation and may provide varying amounts of depth of cut control for the cutting elements. For example, the greater the extension of the DOCC, the greater the depth of cut control provided for the cutting elements. Embodiments of the present disclosure and its advantages are best understood by referring to FIGS. 1 through 5, where like numbers are used to indicate like and corresponding parts.

Figure 1:
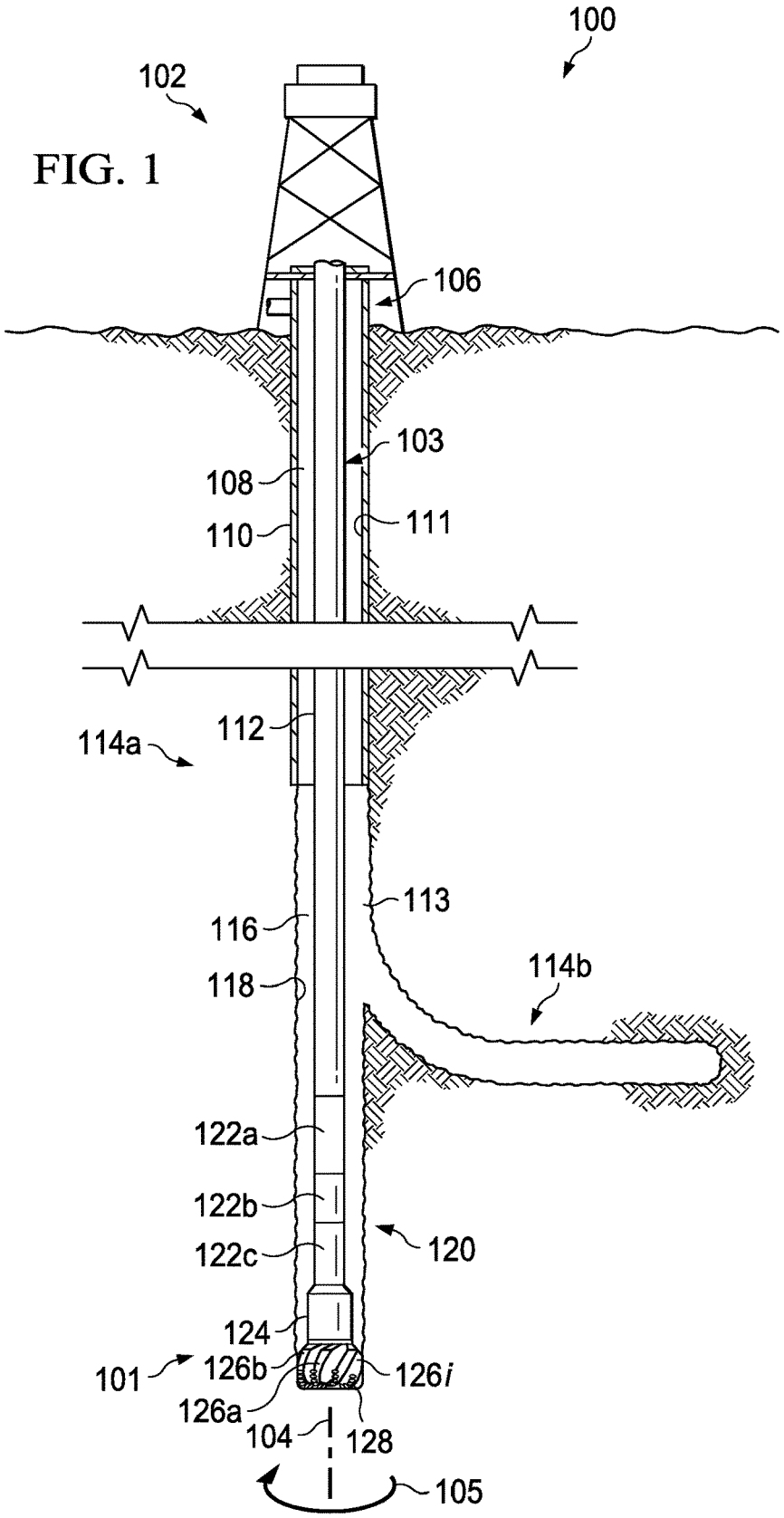
FIG. 1 is an elevation view of an example embodiment of a drilling system, in accordance with some embodiments of the present disclosure.

FIG. 1 is an elevation view of an example embodiment of a drilling system 100, in accordance with some embodiments of the present disclosure. Drilling system 100 may include a well surface or well site 106. Various types of drilling equipment such as a rotary table, drilling fluid pumps, and drilling fluid tanks (not expressly shown) may be located at well surface or well site 106. For example, well site 106 may include drilling rig 102 that may have various characteristics and features associated with a "land drilling rig." However, downhole drilling tools incorporating teachings of the present disclosure may be satisfactorily used with drilling equipment located on offshore platforms, drill ships, semi-submersibles, and drilling barges (not expressly shown).

Drilling system 100 may also include drill string 103 associated with drill bit 101 that may be used to form a wide variety of wellbores or bore holes such as generally vertical wellbore 114*a* or generally horizontal wellbore 114*b* or any combination thereof. Various directional drilling techniques and associated components of bottom hole assembly (BHA) 120 of drill string 103 may be used to form horizontal wellbore 114*b*. For example, lateral forces may be applied to BHA 120 proximate kickoff location 113 to form generally horizontal wellbore 114*b* extending from generally vertical wellbore 114*a*. The term "directional drilling" may be used to describe drilling a wellbore or portions of a wellbore that extend at a desired angle or angles relative to vertical. The desired angles may be greater than normal variations associated with vertical wellbores. Direction drilling may also be described as drilling a wellbore deviated from vertical. The term "horizontal drilling" may be used to include drilling in a direction approximately ninety degrees (90°) from vertical.

BHA 120 may be formed from a wide variety of components configured to form wellbore 114. For example, components 122*a*, 122*b*, and 122*c* of BHA 120 may include, but are not limited to, drill bits (e.g., drill bit 101), coring bits, drill collars, rotary steering tools, directional drilling tools, downhole drilling motors, reamers, hole enlargers, or stabilizers. The number and types of components 122 included in BHA 120 may depend on anticipated downhole drilling conditions and the type of wellbore that will be formed by drill string 103 and rotary drill bit 101. BHA 120 may also include various types of well logging tools (not expressly shown) and other downhole tools associated with directional drilling of a wellbore. Examples of logging tools and/or directional drilling tools may include, but are not limited to, acoustic, neutron, gamma ray, density, photoelectric, nuclear magnetic resonance, rotary steering tools, and/or any other commercially available well tool.

Wellbore 114 may be defined in part by casing string 110 that may extend from well site 106 to a selected downhole location. Portions of wellbore 114, as shown in FIG. 1, that do not include casing string 110 may be described as "open hole." Various types of drilling fluid may be pumped from well surface 106 through drill string 103 to attached drill bit 101. The drilling fluids may be directed to flow from drill string 103 to respective nozzles (depicted as nozzles 156 in FIG. 2) passing through rotary drill bit 101. The drilling fluid may be circulated back to well surface 106 through annulus 108 defined in part by outside diameter 112 of drill string 103 and inside diameter 118 of wellbore 114. Inside diameter 118 may be referred to as the "sidewall" of wellbore 114. Annulus 108 may also be defined by outside diameter 112 of drill string 103 and inside diameter 111 of casing string 110. Open hole annulus 116 may be defined as sidewall 118 and outside diameter 112.

Drilling system 100 may also include rotary drill bit ("drill bit") 101. Drill bit 101, discussed in further detail in FIGS. 2 through 5, may include one or more blades 126 that may be disposed outwardly from exterior portions of rotary bit body 124 of drill bit 101. Rotary bit body 124 may be generally cylindrical and blades 126 may be any suitable type of projections extending outwardly from rotary bit body 124. Drill bit 101 may rotate with respect to bit rotational axis 104 in a direction defined by directional arrow 105. Blades 126 may include one or more cutting elements 128 disposed outwardly from exterior portions of each blade 126. Blades 126 may further include one or more gage pads (not expressly shown) disposed on blades 126. Drill bit 101 may be designed and formed in accordance with teachings of the present disclosure and may have many different designs, configurations, and/or dimensions according to the particular application of drill bit 101.

During the operation of drilling system 100, drill bit 101 may encounter layers of geological formations that may have various compressive strengths. Some formation layers may be described as "softer" or "less hard" when compared to other downhole formation layers. A formation layer described as softer may have a relatively lower compressive strength than a formation layer described as harder. Formation layers may have a mixture of softer and harder geological materials, therefore drill bit 101 may be constantly exposed to changes in compressive strengths. When drill bit 101 bores through a softer formation layer, cutting elements 128 may be able to withstand a relatively large depth of cut and high ROP. When drill bit 101 transitions from a softer formation layer to a harder formation layer, the large depth of cut sustained in the softer formation layer may result in an abrupt increase in the external forces exerted on cutting elements 128, which may increase the likelihood of excessive wear and/or breakage of cutting elements 128. Excessive wear and/or breakage of cutting elements 128 may slow or stop the rate of penetration of drill bit 101. Drill bit 101 may need to be repaired or replaced which may result in delay and additional cost to the drilling operation.

Therefore, while performing drilling into different types of geological formations, a drilling tool may employ a DOCC. A DOCC is a physical structure configured to control the amount that the cutting elements of the drilling tool cut into a geological formation. One or multiple DOCCs may extend and retract to prevent cutting elements 128 from experiencing an excessive depth of cut when transitioning from a softer formation layer to a harder formation layer. A DOCC may engage with a formation layer and may move across the formation layer, providing friction that limits the depth to which cutting elements 128 can engage with the formation layer. A DOCC may provide depth of cut control for cutting elements 128 located in the proximity of the DOCC or may provide depth of cut control for a cutting element 128 located anywhere on drill bit 101.

In some embodiments, one or more of the DOCCs (as discussed in further detail in FIG. 3) may be designed and configured to extend and retract, in real-time, in response to external forces acting on cutting elements 128, such as weight on bit (WOB) or torque on bit (TOB). The drilling parameters vary throughout a drilling operation and may create changing forces on cutting element 128. The changing forces on cutting element 128 may cause the DOCC to extend or retract. The real-time variable depth of cut control is achieved through communicative coupling between one or more cutting elements 128 and one or more DOCCs. The communicative coupling may be a mechanical coupling, a fluidic coupling, or an electrical coupling. For example, an increase in the external forces exerted on cutting element 128 may cause one or more DOCCs to extend beyond the exterior surface of blade 126 of drill bit 101 and engage with the formation layer to control the depth of cut of cutting element 128 and limit the external forces exerted on cutting element 128. The height, shape, and other characteristics of the DOCC may be based on a desired ROP or another drilling parameter, such as WOB, TOB, or revolutions per minute (RPM) for the drilling operation. The DOCC may provide sufficient surface area to engage with the formation and control the depth of cut of cutting elements 128 without exceeding the compressive strength of the formation.

Figure 2:
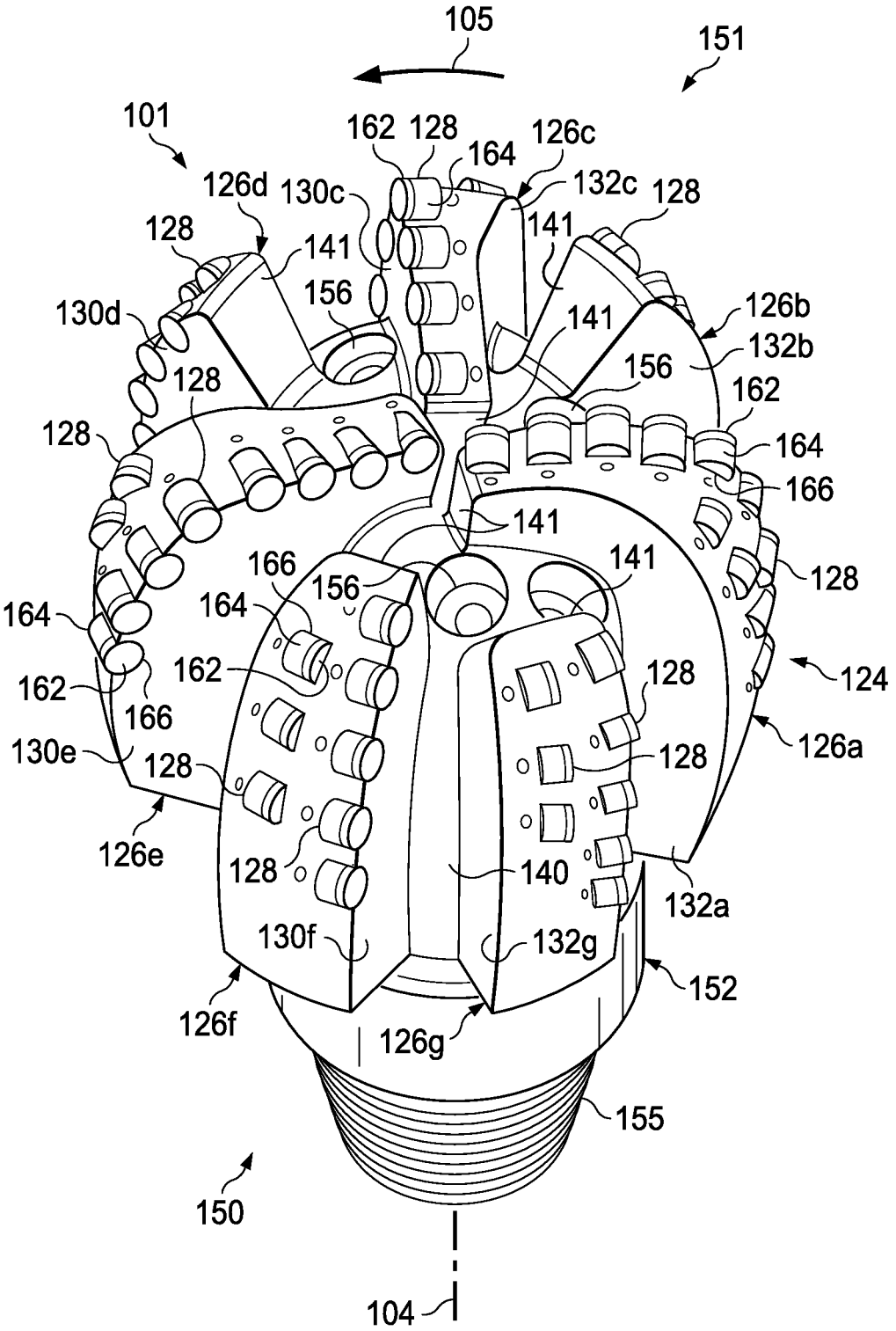
FIG. 2 illustrates an isometric view of a rotary drill bit oriented upwardly in a manner often used to model or design fixed cutter drill bits, in accordance with some embodiments of the present disclosure.

FIG. 2 is an isometric view of rotary drill bit 101 oriented upwardly in a manner often used to model or design fixed cutter drill bits, in accordance with some embodiments of the present disclosure. Drill bit 101 may be any of various types of fixed cutter drill bits, including PDC bits, drag bits, matrix drill bits, and/or steel body drill bits operable to form wellbore 114 extending through one or more downhole formations. Drill bit 101 may be designed and formed in accordance with teachings of the present disclosure and may have many different designs, configurations, and/or dimensions according to the particular application of drill bit 101.

Drill bit 101 may include one or more blades 126 (e.g., blades 126*a*-126*g*) that may be disposed outwardly from exterior portions of rotary bit body 124 of drill bit 101. Rotary bit body 124 may be generally cylindrical and blades 126 may be any suitable type of projections extending outwardly from rotary bit body 124. For example, a portion of blade 126 may be directly or indirectly coupled to an exterior portion of bit body 124, while another portion of blade 126 may be projected away from the exterior portion of bit body 124. Blades 126 formed in accordance with teachings of the present disclosure may have a wide variety of configurations including, but not limited to, substantially arched, helical, spiraling, tapered, converging, diverging, symmetrical, and/or asymmetrical. In some embodiments, one or more blades 126 may have a substantially arched configuration extending from proximate rotational axis 104 of drill bit 101. The arched configuration may be defined in part by a generally concave, recessed shaped portion extending from proximate bit rotational axis 104. The arched configuration may also be defined in part by a generally convex, outwardly curved portion disposed between the concave, recessed portion and exterior portions of each blade which correspond generally with the outside diameter of the rotary drill bit.

Each of blades 126 may include a first end disposed proximate or toward bit rotational axis 104 and a second end disposed proximate or toward exterior portions of drill bit 101 (i.e., disposed generally away from bit rotational axis 104 and toward uphole portions of drill bit 101). The terms "downhole" and "uphole" may be used to describe the location of various components of drilling system 100 relative to the bottom or end of wellbore 114 shown in FIG. 1. For example, a first component described as uphole from a second component may be further away from the end of wellbore 114 than the second component. Similarly, a first component described as being downhole from a second component may be located closer to the end of wellbore 114 than the second component.

Blades 126*a*-126*g* may include primary blades disposed about the bit rotational axis. For example, blades 126*a*, 126*c*, and 126*e* may be primary blades or major blades because respective first ends 141 of each of blades 126*a*, 126*c*, and 126*e* may be disposed closely adjacent to associated bit rotational axis 104. In some embodiments, blades 126*a*-126*g* may also include at least one secondary blade disposed between the primary blades. In the illustrated embodiment, blades 126*b*, 126*d*, 126*f*, and 126*g* on drill bit 101 may be secondary blades or minor blades because respective first ends 141 may be disposed on downhole end 151 a drill bit 101 a distance from associated bit rotational axis 104. The number and location of primary blades and secondary blades may vary such that drill bit 101 includes more or less primary and secondary blades. Blades 126 may be disposed symmetrically or asymmetrically with regard to each other and bit rotational axis 104 where the location of blades 126 may be based on the downhole drilling conditions of the drilling environment. In some cases, blades 126 and drill bit 101 may rotate about rotational axis 104 in a direction defined by directional arrow 105.

Each of blades 126 may have respective leading or front surfaces 130 in the direction of rotation of drill bit 101 and trailing or back surfaces 132 located opposite of leading surface 130 away from the direction of rotation of drill bit 101. In some embodiments, blades 126 may be positioned along bit body 124 such that they have a spiral configuration relative to bit rotational axis 104. In other embodiments, blades 126 may be positioned along bit body 124 in a generally parallel configuration with respect to each other and bit rotational axis 104.

Blades 126 may include one or more cutting elements 128 disposed outwardly from exterior portions of each blade 126. For example, a portion of cutting element 128 may be directly or indirectly coupled to an exterior portion of blade 126 while another portion of cutting element 128 may be projected away from the exterior portion of blade 126. By way of example and not limitation, cutting elements 128 may be various types of cutters, compacts, buttons, inserts, and gage cutters satisfactory for use with a wide variety of drill bits 101. Although FIG. 2 illustrates two rows of cutting elements 128 on blades 126, drill bits designed and manufactured in accordance with the teachings of the present disclosure may have one row of cutting elements or more than two rows of cutting elements.

Cutting elements 128 may be any suitable device configured to cut into a formation, including but not limited to, primary cutting elements, back-up cutting elements, secondary cutting elements, or any combination thereof. Cutting elements 128 may include respective substrates 164 with a layer of hard cutting material (e.g., cutting table 162) disposed on one end of each respective substrate 164. The hard layer of cutting elements 128 may provide a cutting surface that may engage adjacent portions of a downhole formation to form wellbore 114 as illustrated in FIG. 1. The contact of the cutting surface with the formation may form a cutting zone associated with each of cutting elements 128. The edge of the cutting surface located within the cutting zone may be referred to as the cutting edge of a cutting element 128.

Each substrate 164 of cutting elements 128 may have various configurations and may be formed from tungsten carbide or other suitable materials associated with forming cutting elements for rotary drill bits. Tungsten carbides may include, but are not limited to, monotungsten carbide (WC), ditungsten carbide ($W_2C$), macrocrystalline tungsten carbide, and cemented or sintered tungsten carbide. Substrates may also be formed using other hard materials, which may include various metal alloys and cements such as metal borides, metal carbides, metal oxides, and metal nitrides. For some applications, the hard cutting layer may be formed from substantially the same materials as the substrate. In other applications, the hard cutting layer may be formed from different materials than the substrate. Examples of materials used to form hard cutting layers may include polycrystalline diamond materials, including synthetic polycrystalline diamonds. Blades 126 may include recesses or bit pockets 166 that may be configured to receive cutting elements 128. For example, bit pockets 166 may be concave cutouts on blades 126.

In some embodiments, blades 126 may also include one or more DOCCs (not expressly shown) configured to control the depth of cut of cutting elements 128. A DOCC may include an impact arrestor, a back-up cutting element and/or a modified diamond reinforcement (MDR). Exterior portions of blades 126, cutting elements 128 and DOCCs (not expressly shown) may form portions of the bit face. As discussed in more detail in FIGS. 3-5, one or more DOCC elements may be designed and configured to provide real-time variable depth of cut control. A DOCC may be designed and configured to extend and retract in response to external forces experienced by cutting element 128 through coupling between cutting element 128 and a DOCC. A DOCC may control the depth of cut of cutting elements 128 by providing sufficient surface area to engage with the geological formation without exceeding the compressive strength of the formation. The engagement of a DOCC may prevent the excessive wear and/or breakage of cutting elements 128, as described with respect to FIG. 1, by controlling or limiting the penetration of cutting elements 128 into the geological formation.

Blades 126 may further include one or more gage pads (not expressly shown) disposed on blades 126. A gage pad may be a gage, gage segment, or gage portion disposed on exterior portion of blade 126. Gage pads may contact adjacent portions of a wellbore (e.g., wellbore 114 as illustrated in FIG. 1) formed by drill bit 101. Exterior portions of blades 126 and/or associated gage pads may be disposed at various angles, positive, negative, and/or parallel, relative to adjacent portions of generally vertical wellbore 114*a*. A gage pad may include one or more layers of hardfacing material.

Uphole end 150 of drill bit 101 may include shank 152 with drill pipe threads 155 formed thereon. Threads 155 may be used to releasably engage drill bit 101 with BHA 120 whereby drill bit 101 may be rotated relative to bit rotational axis 104. Downhole end 151 of drill bit 101 may include a plurality of blades 126*a*-126*g* with respective junk slots or fluid flow paths 140 disposed therebetween. Additionally, drilling fluids may be communicated to one or more nozzles 156.

Figure 3:
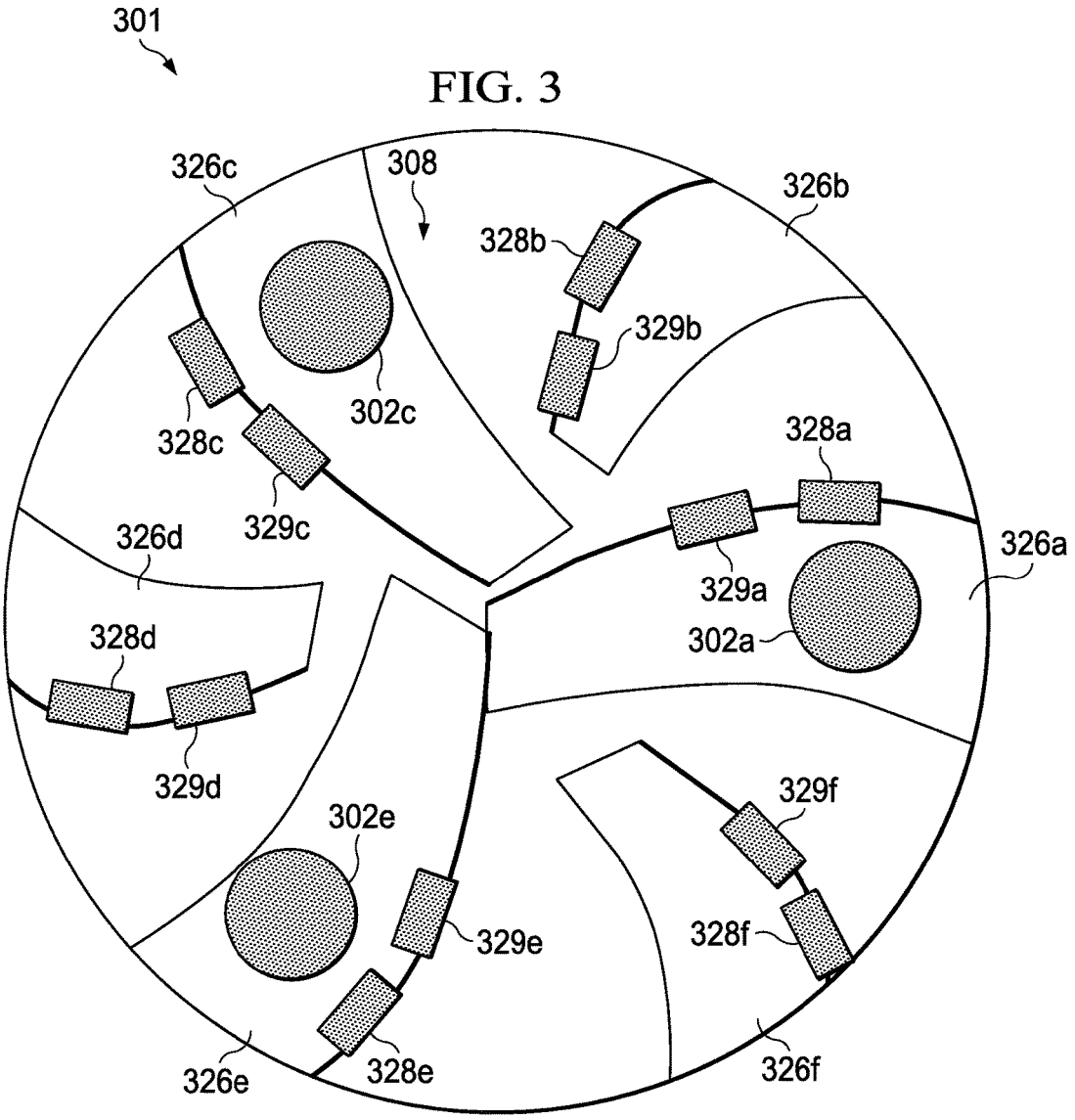
FIG. 3 illustrates a schematic drawing showing various components of a bit face or cutting face disposed on a drill bit or other downhole drilling tool, in accordance with some embodiments of the present disclosure.

FIG. 3 illustrates a schematic drawing showing various components of a bit face or cutting face disposed on drill bit 301 or other downhole drilling tool, in accordance with some embodiments of the present disclosure. Drill bit 301 includes DOCCs 302 (e.g., DOCCs 302*a*, 302*c*, and 302*e*) configured to control the depth of cut of cutting elements 328 and 329 (e.g., cutting elements 328*a*-328*f* and 329*a*-329*f*) disposed on blades 326 (e.g., blades 326*a*-326*f*) of drill bit 301. DOCCs 302 may be coupled, mechanically, hydraulically, electrically or otherwise, as discussed in further detail in FIGS. 4A, 4B, and 4C, to one or more of cutting element 328 and/or 329 such that external forces on cutting elements 328 and/or 329 may cause DOCCs to either extend above the exterior surface of blades 326 or retract below the exterior surface of blades 326. For example, as the external forces on cutting elements 328 and/or 329 increase during a drilling operation, DOCCs 302 may extend outwardly from blades 326 and may provide increased depth of cut control by increasing the surface area of drill bit 301 to counter the external forces acting on drill bit 301 and limit the engagement of cutting elements 328 and/or 329 with the formation. The increased surface area created by one or more DOCCs 302 support drill bit 301 against the bottom of the borehole and control the volume of formation that cutting elements 328 and/or 329 may remove per rotation. Additionally, DOCCs 302 may be configured such that as the external forces acting on cutting elements 328 and/or 329 decrease, DOCCs 302 may retract into blades 326 to provide decreased depth of cut control. Examples of external forces acting on cutting elements 328 and/or 329 include, but are not limited to, WOB and TOB.

By way of example and not limitation, DOCC 302*a* may be coupled to cutting element 328*a*. During a drilling operation, external forces may act on cutting element 328*a* and may vary throughout the drilling operation. During some periods of the drilling operation the external forces may act on cutting element 328*a* such that the external forces cause cutting element 328*a* to move toward blade 326*a* in a direction about the rotational axis 104 as shown in FIG. 2. As cutting element 328*a* moves toward the exterior surface of blade 326*a*, DOCC 302*a* may extend outwardly from the exterior surface of blade 326*a*. During other periods of the drilling operation, the external forces may decrease, such that the external forces may reduce the amount of force causing cutting element 328*a* to move toward blade 326*a* and therefore may cause DOCC 302*a* to retract into blade 326*a*. The forces acting on cutting element 328*a* are communicated to DOCC 302*a* via a coupling mechanism, such as hydraulic, electrical, or mechanical coupling, as described in detail in FIGS. 4A, 4B, and 4C, respectively.

While the example discussed with respect to FIG. 3 illustrates cutting element 328*a* coupled to DOCC 302*a* located on the same blade 326*a*, cutting element 328 may be coupled to DOCC 302 located on a different blade 326. Further FIG. 3 shows DOCCs 302 located on primary blades 326*a*, 326*c*, and 326*e*, however, DOCCs 302 may also be disposed on secondary blades 326*b*, 326*d*, and 326*f*. Additionally, in some embodiments, a single cutting element 328 or 329 may be coupled to a single DOCC 302 or multiple DOCCs 302. Coupling multiple DOCCs 302 to a single cutting element 328 or 329 may increase the surface area of DOCCs 302 in the event that space constraints on blade 326 prevent a single DOCC 302 from achieving the surface area required to provide the desired depth of cut control. For example, in some embodiments blade 326 may not have space for a single DOCC of the desired size to be disposed on one location of blade 326. However, blade 326 may have space for smaller DOCCs positioned at various locations along blade 326 such that the total surface area associated with the multiple DOCCs provides the desired depth of cut control. Coupling multiple DOCCs 302 to a single cutting element 328 or 329 may also provide redundancy for controlling the depth of cut of cutting element 328 or 329. For example, if one DOCC 302 fails, another DOCC 302 may serve as a backup for the failed DOCC. Additionally, in cases where the compressive strength of the geological formation is relatively low, multiple DOCCs 302 may be required to adequately control the depth of cut of cutting element 328 or 329. For example, a geological formation with a relatively low compressive strength may require that the load exerted on DOCCs 302 be spread over multiple points of contact on drill bit 301.

In some embodiments, a single DOCC 302 may be coupled to a single cutting element 328 or 329 or multiple cutting elements 328 and/or 329. Drill bit 301 may have space limitations such a one-to-one relationship between a single DOCC 302 and a single cutting element 328 or 329 is not possible. Coupling a single DOCC 302 to multiple cutting elements 328 and/or 329 may also reduce the manufacturing cost of drill bit 301. Further, in drilling operations where the compressive strength of the geological formation is relatively high, a single DOCC 302 may provide adequate contact with the geological formation in order to control the depth of cut of multiple cutting elements 328 and/or 329.

Modifications, additions or omissions may be made to FIG. 3 without departing from the scope of the present disclosure. For example, although DOCCs 302 are depicted as being substantially round, DOCCs 302 may be configured to have any suitable shape depending on the design constraints and considerations of DOCCs 302. Additionally, although drill bit 301 includes a specific number of DOCCs 302 and a specific number of blades 326, drill bit 301 may include more or fewer DOCCs 302 and more or fewer blades 326. DOCCs 302 can be made of any suitable material depending on the design constraints and considerations of DOCCs 302.

Figure 4A:
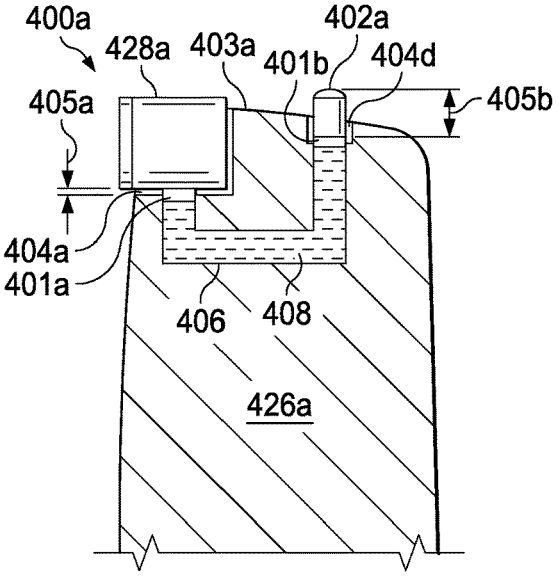
FIGS. 4A, 4B, and 4C illustrate cross-sectional views showing various components of a blade of a drill bit or other drilling tool, in accordance with some embodiments of the present disclosure.
Figure 4B:
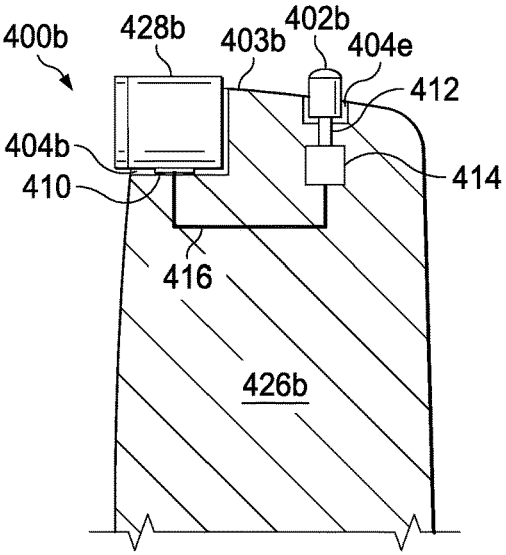
Figure 4C:
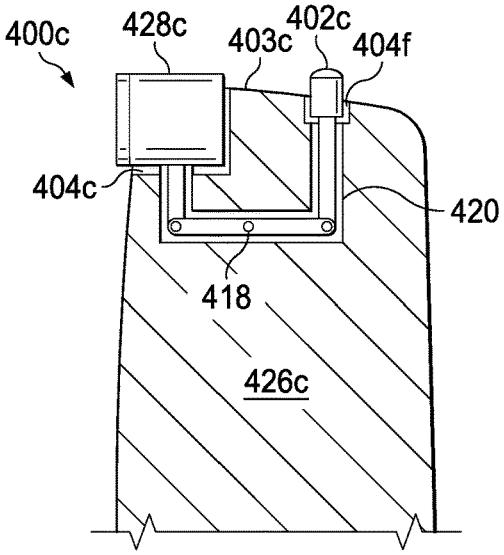

FIGS. 4A, 4B, and 4C illustrate cross-sectional views 400*a*, 400*b*, and 400*c* showing various components of blade 426*a*, 426*b*, and 426*c* of drill bit 101 or other drilling tool, in accordance with some embodiments of the present disclosure. Blades 426 may include cutting elements 428 (e.g., cutting elements 428*a*-428*c*) and DOCCs 402 (e.g., DOCCs 402*a*-402*c*). Cutting element 428 and DOCC 402 may be coupled via hydraulic, electrical, mechanical, or other suitable mechanism. Blades 426 of drill bit 101 may include recesses or bit pockets 404 (e.g., bit pockets 404*a*-404*d*) that may be configured to receive cutting elements 428 and/or DOCCs 402. For example, bit pockets 404 may be concave cutouts formed in blades 428. Cutting element 428 and DOCC 402 may be of any suitable shape or size.

In some embodiments, DOCCs 402*a* may be coupled to cutting element 428*a* via a fluidic or hydraulic connection, such as via hydraulic channel 406 internal to blade 426*a*, as shown in FIG. 4A. Cutting element 428*a* may be coupled to hydraulic channel 406 at bit pocket 404*a* of drill bit 101, where bit pocket 404*a* may include floating platform 401*a* suspended or floating on hydraulic fluid 408 located in hydraulic channel 406. Cutting element 428*a* may be coupled to the top portion of floating platform 401*a* via soldering, welding, brazing, adhesive, or any other suitable attachment method. The top of floating platform 401*a* may define a section of bit pocket 404*a* that forms a recess in blade 426. A first end of hydraulic channel 406 may be defined by the bottom of floating platform 401*a* such that floating platform 401*a* floats on hydraulic fluid 408. Floating platform 401*a* may be designed such that it forms a seal to prevent hydraulic fluid 408 from exiting hydraulic channel 406. For example, floating platform 401*a* may be designed as a slip fit, where force is required to cause floating platform 401*a* to move in hydraulic channel 406. When no force is applied to cutting element 428*a*, the friction of the slip fit may prevent floating platform 401*a* from moving and may seal hydraulic channel 406. Floating platform 401*a* may also include o-rings, gaskets, or any other suitable sealing mechanism designed to form a seal around the bottom of floating platform 401*a* and prevent hydraulic fluid 408 from leaking out of hydraulic channel 406.

DOCC 402*a* may be suspended or floating on hydraulic fluid 408 at a location along hydraulic channel 406. In some embodiments, DOCC 402*a* and cutting element 428*a* may be located at opposite ends of hydraulic channel 406. DOCC 402*a* may be coupled to a second end of hydraulic channel 406 at floating platform 401*b* of drill bit 101, where floating platform 401*b* may be suspended or floating on hydraulic fluid 408 located in hydraulic channel 406. DOCC 402*a* may be coupled to floating platform 401*b* via soldering, welding, brazing, adhesive, or any other attachment method. Floating platform 401*b* may be designed such that it forms a seal to prevent hydraulic fluid 408 from exiting hydraulic channel 406. For example, floating platform 401*b* may be designed as a slip fit and/or include o-rings, gaskets, or any other suitable sealing mechanism around the bottom of floating platform 401*b*. DOCC 402*a* may be designed such that height 405*b* of DOCC 402*a* is greater than distance 405*a*, which corresponds to the distance cutting element 428*a* extends above the surface of bit pocket 404*a*. This design may allow cutting element 428*a* move until cutting element 428*a* is in contact with the surface of bit pocket 404*a* without DOCC 402*a* extending an amount greater than height 405*b* of DOCC 402*a*.

As external forces (e.g., force from WOB and/or TOB) act on cutting element 428*a* during a drilling operation, DOCC 402*a* may be extended to engage with the formation and control the depth of cut of cutting element 428*a*. For example, the force may cause cutting element 428*a* to move toward the surface of bit pocket 404*a* and thus move the bottom of floating platform 401*a* into hydraulic channel 406. The movement of floating platform 401*a* may cause an increase in the pressure of hydraulic fluid 408 in hydraulic channel 406 located under floating platform 401*a*. The pressure increase of hydraulic fluid 408 may be communicated through hydraulic channel 406 to floating platform 401*b* and may act on floating platform 401*b*, causing DOCC 402*a* to extend outwards from the surface of bit pocket 404*d* by an amount proportional to the amount floating platform 401*a* is moved in hydraulic channel 406. The external forces acting on cutting element 428*a* may vary depending on in what zone of drill bit 101 cutting element 428*a* is located and the amount DOCC 402*a* may extend may be variable based on the zone of drill bit 101. The zones of drill bit 101 are discussed in more detail in the discussion accompanying FIG. 5.

When the external forces on cutting element 428*a* decrease during a drilling operation due to the engagement of DOCC 402*a* or a change in the compressive strength of the formation, cutting element 428*a* may move away from the surface of bit pocket 404*a* and DOCC 402*a* may retract toward the surface of bit pocket 404*d*. For example, as the forces acting on cutting element 428*a* decrease, cutting element 428*a* may move away from the surface of bit pocket 404*a* and the pressure on hydraulic fluid 408 may be reduced. The pressure reduction of hydraulic fluid 408 may cause DOCC 402*a* to retract into bit pocket 404*d*. The coupling between cutting element 428*a* and DOCC 402*a* may be such that DOCC 402*a* may remain extended some amount above surface 403*a* of blade 426*a* or it may be such that DOCC 402*a* retracts below surface 403*a* of blade 426*a*.

Cutting element 428*b* may be electrically coupled to DOCC 402*b*, as illustrated in FIG. 4B. For example, pressure sensor 410, which may translate a pressure to an amount of force acting on cutting element 428*b*, may be associated with cutting element 428. Pressure sensor 410 may include a pressure transducer, piezometer, manometer, strain gauge, and/or any other suitable sensor for detecting pressure changes on a surface. Pressure sensor 410 may be configured to send an electrical signal, via electrical lead 416, to motor 414, which may be communicatively coupled to piston 412. Piston 412 may be coupled to DOCC 402*b*. Motor 414 may cause piston 412 to extend or retract DOCC 402*b* based on the signals received from pressure sensor 410. Motor 414 may include a servomotor, stepper motor, electric motor, and/or any other suitable motor for operating mechanical devices. The components of the electrical connection may be internal to blade 426*b*.

As discussed with reference to FIG. 4A, external forces acting on cutting element 428*b* during a drilling operation may cause DOCC 402*b* to extend from the surface of bit pocket 404*e* in order to control the depth of cut of cutting element 428*b*. For example, the force may exert pressure on cutting element 428*b*. Pressure sensor 410 may detect an increase in pressure and send a signal to motor 414 via electrical lead 416. The signal may cause motor 414 to move piston 412. The movement of piston 412 may cause DOCC 402*b* to move above surface 403*b* of blade 426*b* by an amount relative to the amount of pressure sensed by pressure sensor 410. The relative amount that DOCC 402*b* moves may be proportional or non-proportional to the amount of pressure sensed by pressure sensor 410 and may vary depending on in what zone cutting element 428*b* is located on drill bit 101 as discussed in more detail in the discussion accompanying FIG. 5.

As DOCC 402*b* controls the depth of cut of cutting element 428*c* by engaging with the formation or as the compressive strength of the formation decreases, the amount of external force exerted on cutting element 428*b* may decrease and may cause DOCC 402*b* to retract. For example, as the force experienced by cutting element 428*b* decreases, the pressure sensed by pressure sensor 410 may also decrease. Pressure sensor 410 may send a signal to motor 414 via electrical lead 416 indicating the pressure reduction. The signal may cause motor 414 to move piston 412 and may cause DOCC 402*b* to retract to an original position or an intermediate position depending on the amount of pressure exerted on cutting element 428*b*. The coupling between cutting element 428*b* and DOCC 402*b* may be such that DOCC 402*b* may remain extended some amount above surface 403*b* or it may be such that DOCC 402*b* retracts below surface 403*b*.

An embodiment where cutting element 428*b* and DOCC 402*b* are electrically communicatively coupled may also include a controller (not expressly shown) that translates the electrical signal from pressure sensor 410 into an electrical signal that may be sent to motor 414. The controller may determine the relative amount DOCC 402*b* may extend based on the signal received from pressure sensor 410. The controller may also be programmed to limit the amount of travel of DOCC 402*b* to prevent DOCC 402*b* from extending beyond the height of DOCC 402*b*. A controller may be programmed to move some DOCCs 402 by a proportional amount and other DOCCs 402 by a non-proportional amount.

As illustrated in FIG. 4C, cutting element 428*c* may be mechanically coupled to DOCC 402*c*. For example, cutting element 428*c* and DOCC 402*c* may be coupled to one another via mechanical linkage 420 where cutting element 428*c* and DOCC 402*c* may be coupled to opposite ends of mechanical linkage 420 via brazing, soldering, welding, adhesive, threading, or any other attachment method. Mechanical linkage 420 may be internal to the surface of blade 426*c* and may include pin 418 positioned along mechanical linkage 420. Pin 418 may act as a fulcrum and allow DOCC 402*c* to extend or retract in response to external forces acting on by cutting element 428*c*.

During a drilling operation, in order to control the depth of cut of cutting element 428*c*, external forces acting on cutting element 428*c* may cause DOCC 402*c* to extend from the surface of bit pocket 404*f*. For example, the increased force may cause cutting element 428*c* to move toward the surface of bit pocket 404*c*. As cutting element 428*c* moves toward the surface of bit pocket 404*c*, mechanical linkage 420 may pivot about the location of pin 418 and may cause DOCC 402*c* to extend above surface 403*c* of blade 426*c*.

As DOCC 402*c* engages with the formation to control the depth of cut of cutting element 428*c* or as the compressive strength of the formation decreases, the force exerted on cutting element 428*c* may decrease and cause cutting element 428*c* to move away from the surface of bit pocket 404*c*. When cutting element 428*c* moves away from the surface of bit pocket 404*c*, mechanical linkage 420 may pivot about pin 418 and may cause DOCC 402*c* to retract into bit pocket 404*f*. The coupling between cutting element 428*c* and DOCC 402*c* may be such that DOCC 402*c* may remain extended some amount above surface 403*c* or it may be such that DOCC 402*c* retracts below surface 403*c*. The location of pin 418 may be determined based on the desired proportion between the force exerted on cutting element 428*c* and the desired amount of extension of DOCC 402*c*. For example, if a one-to-one proportion is desired, pin 418 may be located in the center of mechanical linkage 420. However, if a different proportion is desired, pin 418 may be moved closer to DOCC 402*c* or closer to cutting element 428*c* to achieve the desired proportion.

In some embodiments, the coupling between DOCC 402 (e.g., DOCC 402*a*, 402*b*, or 402*c*) and cutting element 428 (e.g., 428*a*, 428*b*, or 428*c*) may be designed such that DOCC 402 may move once the external forces acting on cutting element 428 are above a threshold level. For example, if the external forces acting on cutting element 428 are below the threshold, DOCC 402 may remain in its initial position. If the external forces acting on cutting element 428 are above the threshold, DOCC 402 may begin to extend based on the external force. In some embodiments, the threshold may be zero. In other embodiments, the threshold may be a non-zero value based on the compressive strength of the formation. The threshold may be based on predicted external forces experienced by cutting element 428 at a specified value for a drilling parameter, such as ROP, WOB, TOB, or RPM. The drilling parameters may be based on a given compressive strength and/or other properties of the geological formation, the type of bit used, hole size, well profile, drilling dynamics, drilling fluid type, and/or drilling fluid flow rate. A real-time variable DOCC, such as DOCC 402, may be designed to be in contact with the geological formation at a desired drilling parameter and thus maintain the depth of cut of cutting element 428 at the desired drilling parameter.

The distance DOCC 402 may extend above blade 426 of drill bit 101 in response to external forces acting on cutting element 428 may be based on the size of DOCC 402. For example, the larger the surface area of DOCC 402, the less distance DOCC 402 may extend above the surface of blade 426 to achieve the desired amount of DOCC engagement to control the depth of cut of cutting element 428. In some embodiments, the amount DOCC 402 extends above the surface of blade 426 may be proportional to the amount cutting element 428 moves in response to the external forces such that the ratio of extension of DOCC 402 to movement of cutting element 428 may be one-to-one. In other embodiments, the amount DOCC 402 extends may not be proportional to the movement of cutting element 428. In this example, the ratio of extension of DOCC 402 to movement of cutting element 428 may be in a range between approximately one-to-one and approximately one-to-two. By way of example and not limitation, DOCC 402 may have a maximum extension above the surface of blade 426 of approximately twice the maximum distance that cutting element 428 may be move toward the surface of bit pocket 404. In addition, cutting element 428 may be configured such that the amount of movement allowed relative to blade 426 is limited. For example, cutting element 428 may be configured to allow cutting element 428 to move by a maximum distance of approximately 0.010-inch.

When no external forces are acting on cutting elements 428, DOCCs 402 may be in their resting positions. In some embodiments, a portion of DOCC 402 may extend above surface 403 of blade 426 in the resting position. In other embodiments, the resting position of DOCC 402 may be such that all portions of DOCC 402 are located below surface 403 of blade 426. In further embodiments, the resting position of DOCC 402 may be such that the top of DOCC 402 is flush with surface 403 of blade 426.

Modifications, additions or omissions may be made to FIG. 4 without departing from the scope of the present disclosure. For example, hydraulic fluid 408 may be any type of hydraulic fluid such as water, mineral oil, and/or any other suitable fluid. Mechanical linkage may be manufactured from metal, plastic, composite materials, or any other suitable material for use under downhole drilling conditions.

Figure 5:
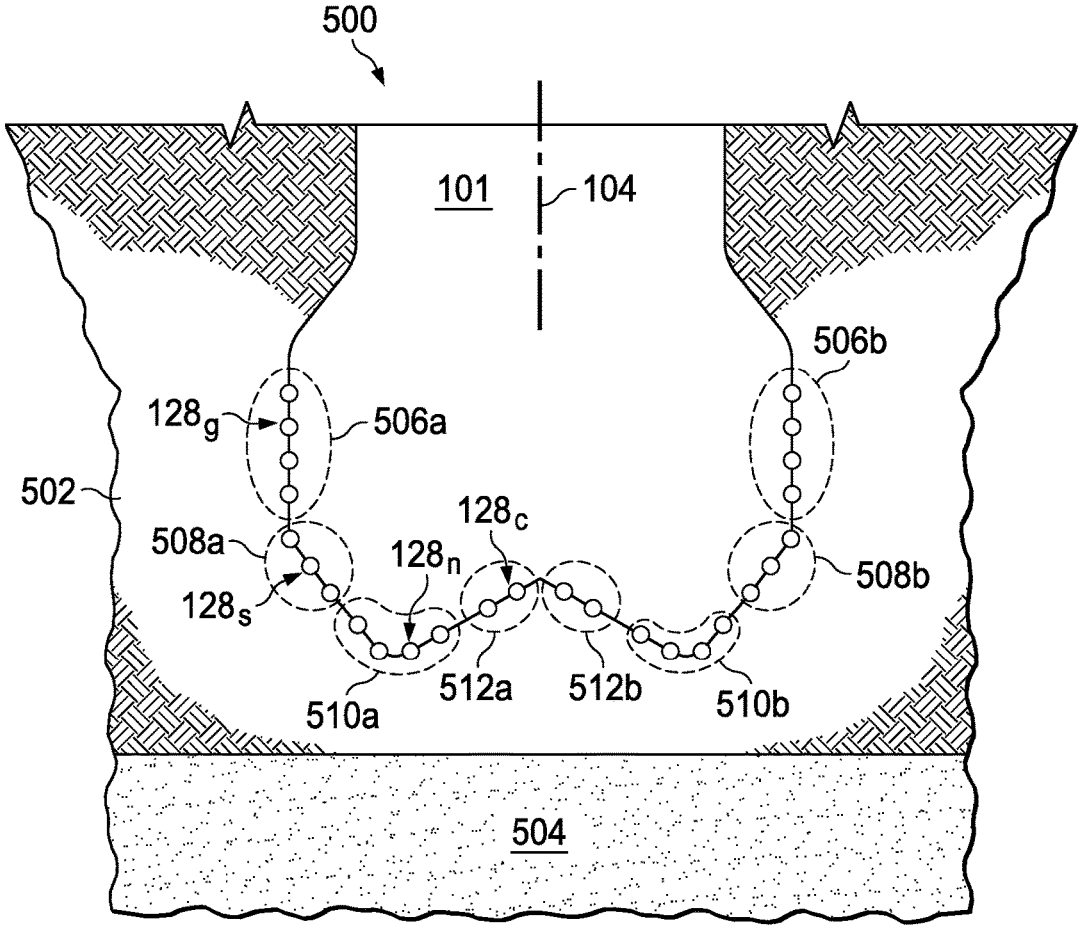
FIG. 5 illustrates a bit face profile of drill bit configured to form a wellbore through a first formation layer into a second formation layer, in accordance with some embodiments of the present disclosure.

FIG. 5 illustrates a bit face profile 500 of drill bit 101 configured to form a wellbore through a first formation layer 502 into a second formation layer 504, in accordance with some embodiments of the present disclosure. Exterior portions of blades (not expressly shown), cutting elements 128 and DOCCs (not expressly shown) may be projected rotationally onto a radial plane to form bit face profile 500. In the illustrated embodiment, formation layer 502 may be described as softer when compared to downhole formation layer 504.

As discussed with respect to FIG. 1, while drill bit 101 bores through softer formation layer 502, cutting elements 128 may be able to withstand a relatively large depth of cut and high ROP. When drill bit 101 transitions from softer formation layer 502 to harder formation layer 504, the large depth of cut sustained in formation layer 502 may result in an increase in the external forces exerted on cutting elements 128. As described in FIG. 4, an increase in the external forces exerted on cutting element 128 may cause one or more DOCCs to extend beyond the surface of a blade of drill bit 101 and engage with the formation layer to control the depth of cut of cutting element 128 and limit the external forces exerted on cutting element 128. A fixed or non-variable DOCC may be designed for a specific formation and perform optimally in the specific formation layer and have reduced performance in formation layers with different characteristics. A real-time variable DOCC, as described in this disclosure, may provide optimal or improved depth of cut control in a variety of formation layers, each having various properties. Therefore a real-time variable DOCC may provide for more efficient drilling through a variety of formation layers.

One or multiple DOCCs may prevent cutting elements 128 from engaging the formation at an excessive depth of cut when transitioning from softer formation layer 502 to harder formation layer 504. A DOCC may provide depth of cut control for cutting elements 128 located in the proximity of the DOCC or may provide depth of cut control for a cutting element 128 located anywhere on drill bit 101.

As shown in FIG. 5, exterior portions of drill bit 101 that contact adjacent portions of a downhole formation may be described as a "bit face." Bit face profile 500 of drill bit 101 may include various zones or segments. Bit face profile 500 may be substantially symmetric about bit rotational axis 104 due to the rotational projection of bit face profile 500, such that the zones or segments on one side of rotational axis 104 may be substantially similar to the zones or segments on the opposite side of rotational axis 104.

For example, bit face profile 500 may include gage zone 506*a* located opposite gage zone 506*b*, shoulder zone 508*a* located opposite shoulder zone 508*b*, nose zone 510*a* located opposite nose zone 510*b*, and cone zone 512*a* located opposite cone zone 512*b*. Cutting elements 128 included in each zone may be referred to as cutting elements of that zone. For example, cutting elements $\mathbf{128}_g$ included in gage zones 506 may be referred to as gage cutting elements, cutting elements $\mathbf{128}_s$ included in shoulder zones 508 may be referred to as shoulder cutting elements, cutting elements $\mathbf{128}_n$ included in nose zones 510 may be referred to as nose cutting elements, and cutting elements $\mathbf{128}_c$ included in cone zones 512 may be referred to as cone cutting elements.

Cone zones 512 may be generally concave and may be formed on exterior portions of each blade (e.g., blades 126 as illustrated in FIG. 2) of drill bit 101, adjacent to and extending out from bit rotational axis 104. Nose zones 510 may be generally convex and may be formed on exterior portions of each blade of drill bit 101, adjacent to and extending from each cone zone 512. Shoulder zones 508 may be formed on exterior portions of each blade 126 extending from respective nose zones 510 and may terminate proximate to respective gage zone 506.

According to the present disclosure, a DOCC (not expressly shown) may be configured along bit face profile 500 to provide depth of cut control for cutting elements 128. The design of each DOCC configured to control the depth of cut may be based at least partially on the location of each cutting element 128 with respect to a particular zone of the bit face profile 500 (e.g., gage zone 506, shoulder zone 508, nose zone 510 or cone zone 512). Each DOCC in a particular zone of the bit face profile may be designed such that the effect of the DOCC corresponds with the particular zone in which the DOCC is located. For example, the forces in nose zone 510 may be higher than the forces in gage zone 506 and a force may cause a DOCC in nose zone 510 to extend by a greater distance above a surface of a blade of drill bit 101 than the same force acting on cutting element $\mathbf{128}_g$ may cause a DOCC in gage zone 506 to extend.

Additionally, the amount of external force experienced by cutting element 428 may be different based on the zone of drill bit 101 on which cutting element 428 is located. DOCC 402 may be designed to engage with the geological formation by varying amounts, based on the zone of drill bit 101 on which DOCC 402 is located. For example, drill bit 101 may be designed to allow a greater WOB for cutting elements 128 in some zones when compared to cutting elements 128 in other zones on drill bit 101. As a result, a DOCC located in such zone would extend a smaller amount above the surface of drill bit 101 than would a DOCC located in another zone when the same amount of WOB is experienced by cutting elements 128 in the respective zones.

FIG. 5 is for illustrative purposes only and modifications, additions or omissions may be made to FIG. 5 without departing from the scope of the present disclosure. For example, the actual locations of the various zones with respect to the bit face profile may vary and may not be exactly as depicted. The location and size of cutting zones 506, 508, 510, and/or 512 (and consequently the location and size of cutting elements 128) may depend on factors including the ROP and RPM of the bit, the size of cutting elements 128, and the location and orientation of cutting elements 128 along the blade profile of the blade, and accordingly the bit face profile of the drill bit. Additionally, the DOCC disclosed may be located on any type of downhole drilling device, such as a drill bit, a coring bit, a reamer, a hole opener, and/or any other suitable device. Further, as mentioned above, the various zones of bit face profile 500 may be based on the profile of blades 126 of drill bit 101.

Embodiments disclosed herein include:

A. A drill bit including a bit body, a plurality of blades on the bit body, a cutting element on one of the plurality of blades, and a depth of cut controller (DOCC) on one of the plurality of blades, the DOCC is coupled to the cutting element such that the DOCC moves in response to an external force on the cutting element.

B. A drilling system including a drill string and a downhole drilling tool coupled to the drill string. The downhole drilling tool including a bit body, a plurality of blades on the bit body, a cutting element on one of the plurality of blades, and a depth of cut controller (DOCC) on one of the plurality of blades, the DOCC is coupled to the cutting element such that the DOCC moves in response to an external force on the cutting element.

C. A method for drilling a wellbore including forming a wellbore with a drill bit including a cutting element on a blade coupled to a depth of cut controller (DOCC), determining an external force exerted on the cutting element, and actuating the DOCC in response to the determined external force.

Each of embodiments A, B, and C may have one or more of the following additional elements in any combination: Element 1: wherein the DOCC is coupled to the cutting element via a mechanical connection including a mechanical linkage connecting the DOCC and the cutting element and a pin about which the mechanical linkage pivots. Element 2: wherein the DOCC is coupled to the cutting element via a fluidic connection including a channel, a fluid filling the channel, a first platform coupled to the cutting element to form a first end of the channel, and a second platform coupled to the DOCC to form a second end of the channel. Element 3: wherein the DOCC is coupled to the cutting element via an electrical connection including a sensor associated with the cutting element and a motor associated with the DOCC, the motor configured to receive a signal from the sensor in response to the external force and move the DOCC based on the signal. Element 4: wherein the DOCC is configured to extend above a surface of the blade in response to the external force exceeding a threshold. Element 5: wherein the DOCC is configured to retract below a surface of the blade in response to the external force falling below a threshold. Element 6: wherein the DOCC is configured to move a proportional amount in relation to the external force exerted on the cutting element, the external force comprises weight on bit (WOB) or torque on bit (TOB). Element 7: wherein the DOCC is coupled to more than one cutting element. Element 8: wherein the cutting element is coupled to more than one DOCC. Element 9: wherein the DOCC and the cutting element are located on a single blade of the plurality of blades. Element 10: wherein the DOCC and the cutting element are located in a single zone of the drill bit.

Although the present disclosure and its advantages have been described in detail, it should be understood that various changes, substitutions and alterations can be made herein without departing from the spirit and scope of the disclosure as defined by the following claims.

What is claimed is:

1. A drill bit, comprising:

a bit body;

a plurality of blades on the bit body;

a cutting element on one of the plurality of blades; and a depth of cut controller (DOCC) on one of the plurality of blades, the DOCC is coupled to the cutting element such that the DOCC moves in response to an external force on the cutting element to directly engage with a geological formation.

2. The drill bit of claim 1, wherein the DOCC is coupled to the cutting element via a mechanical connection comprising:

a mechanical linkage connecting the DOCC and the cutting element; and a pin about which the mechanical linkage pivots.

3. The drill bit of claim 1, wherein the DOCC is coupled to the cutting element via a fluidic connection comprising:

a channel;

a fluid filling the channel;

a first platform coupled to the cutting element to form a first end of the channel; and a second platform coupled to the DOCC to form a second end of the channel.

4. The drill bit of claim 1, wherein the DOCC is coupled to the cutting element via an electrical connection comprising:

a sensor communicatively coupled to the cutting element; and a motor communicatively coupled to the DOCC, the motor configured to receive a signal from the sensor in response to the external force and move the DOCC based on the signal.

5. The drill bit of claim 1, wherein the DOCC is configured to extend above a surface of the blade in response to the external force exceeding a threshold; and the DOCC is configured to retract below the surface of the blade in response to the external force falling below a threshold.

6. The drill bit of claim 1, wherein the DOCC is configured to move a proportional amount in relation to the external force exerted on the cutting element, the external force comprises weight on bit (WOB) or torque on bit (TOB).

7. The drill bit of claim 1, wherein the DOCC is coupled to more than one cutting element.

8. The drill bit of claim 1, wherein the cutting element is coupled to more than one DOCC.

9. The drill bit of claim 1, wherein the DOCC and the cutting element are located on a single blade of the plurality of blades.

10. The drill bit of claim 1, wherein the DOCC and the cutting element are located in a single zone of the drill bit.

11. A drilling system, comprising:

a drill string; and a downhole drilling tool coupled to the drill string, the downhole drilling tool comprising:

a bit body;

a plurality of blades on the bit body;

a cutting element on one of the plurality of blades; and a depth of cut controller (DOCC) on one of the plurality of blades, the DOCC is coupled to the cutting element such that the DOCC moves in response to an external force on the cutting element to directly engage with a geological formation.

12. The drilling system of claim 11, wherein the DOCC is coupled to the cutting element via a mechanical connection comprising:

a mechanical linkage connecting the DOCC and the cutting element; and a pin about which the mechanical linkage pivots.

13. The drilling system tool of claim 11, wherein the DOCC is coupled to the cutting element via a fluidic connection comprising:

a channel;

a fluid filling the channel;

a first platform coupled to the cutting element to form a first end of the channel; and a second platform coupled to the DOCC to form a second end of the channel.

14. The drilling system of claim 11, wherein the DOCC is coupled to the cutting element via an electrical connection comprising:

a sensor communicatively coupled to the cutting element; and a motor communicatively coupled to the DOCC, the motor configured to receive a signal from the sensor in response to the external force and move the DOCC based on the signal.

15. The drilling system of claim 11, wherein the DOCC is configured to extend above a surface of the blade in response to the external force exceeding a threshold; and the DOCC is configured to retract below the surface of the blade in response to the external force falling below a threshold.

16. The drilling system of claim 11, wherein the DOCC is configured to move a proportional amount in relation to the external force exerted on the cutting element, the external force comprises weight on bit (WOB) or torque on bit (TOB).

17. The drilling system of claim 11, wherein the DOCC is coupled to more than one cutting element.

18. The drilling system of claim 11, wherein the cutting element is coupled to more than one DOCC.

19. The drilling system of claim 11, wherein the DOCC and the cutting element are located on a single blade of the plurality of blades.

20. The drilling system of claim 11, wherein the DOCC and the cutting element are located in a single zone of the drill bit.

21. A method for drilling a wellbore, comprising:

contacting a cutting element of a drill bit with a subterranean formation to form a wellbore, the cutting element coupled to a depth of cut controller (DOCC);

exerting an external force on the cutting element based on the contact between the cutting element and the subterranean formation;

actuating the DOCC in response to the external force; and engaging the DOCC with the subterranean formation.

22. The method of claim 21, wherein actuating the DOCC comprises:

pivoting a mechanical linkage about a pin in response to the external force exerted on the cutting element, the mechanical linkage coupling the DOCC to the cutting element; and actuating the DOCC based on the pivoting of the mechanical linkage.

23. The method of claim 21, actuating the DOCC comprises:

increasing a hydraulic pressure of a fluid filling a channel coupling the cutting element and the DOCC in response to the external force exerted on the cutting element; and actuating the DOCC based on the increased hydraulic pressure.

24. The method of claim 21, wherein actuating the DOCC comprises:

generating a signal at a sensor based on the external force exerted on the cutting element;

receiving the signal at a motor communicatively coupled to the DOCC; and actuating the DOCC by the motor based on the signal.

25. The method of claim 21, wherein actuating the DOCC comprises:

comparing the external force to a threshold;

extending the DOCC above a surface of the blade in response to the external force exceeding the threshold; and retracting the DOCC below the surface of the blade in response to the external force falling below the threshold.

26. The method of claim 21, wherein the DOCC is coupled to a plurality of cutting elements and is actuated in response to the external force being exerted on more than one of the plurality of cutting elements.

27. The method of claim 21, wherein a plurality of DOCCs are actuated in response to the external force exerted on the cutting element.

* * * * *